United States Patent [19]

Heydner et al.

[11] 4,236,136

[45] Nov. 25, 1980

[54] TRIPPING DEVICE FOR AN OVERLOAD CIRCUIT BREAKER

[75] Inventors: Konrad Heydner; Josef Peter; Rainer Völkl, all of Altdorf, Fed. Rep. of Germany

[73] Assignee: Ellenberger & Poensgen GmbH, Altdorf, Fed. Rep. of Germany

[21] Appl. No.: 970,176

[22] Filed: Dec. 18, 1978

[30] Foreign Application Priority Data

Jan. 2, 1978 [DE] Fed. Rep. of Germany ..... 2800032

[51] Int. Cl.[3] ..... H01H 71/16

[52] U.S. Cl. ..... 337/111; 335/43; 337/379

[58] Field of Search ..... 337/111, 379, 70, 66, 337/46; 335/43, 44, 45

[56] References Cited

U.S. PATENT DOCUMENTS 4,024,487 5/1977 Krasser et al. ..... 337/46

FOREIGN PATENT DOCUMENTS 646009 6/1937 Fed. Rep. of Germany ..... 337/111

*Primary Examiner*—Harold Broome

*Attorney, Agent, or Firm*—Spencer & Kaye

[57] ABSTRACT

An overload circuit breaker has a housing and a tripping device supported in the housing and having a helically wound, current-carrying bimetal strip composed of two face-to-face arranged metal components situated, respectively, at the inside and at the outside of the bimetal strip. The bimetal strip has a tripping portion which executes a tripping motion as the bimetal strip undergoes deformation under the effect of heat generated by an excess current flowing through the bimetal strip. The bimetal strip is formed of two electrically serially connected, oppositely wound bimetal helices each having an outer end constituting the opposite ends of the bimetal strip. The bimetal strip is affixed to the housing at both of its opposite ends. Further, the bimetal helices each have an inner end connected to one another by a coupling part. The coupling part constitutes the tripping portion of the bimetal strip.

11 Claims, 3 Drawing Figures

TRIPPING DEVICE FOR AN OVERLOAD CIRCUIT BREAKER

BACKGROUND OF THE INVENTION

This invention relates to a tripping device which is incorporated in an overload circuit breaker and which has a helically bent bimetal strip attached to the housing of the circuit breaker. One metal component of the bimetal strip is arranged at the inside of the helix, while the other metal component is arranged at the outside thereof. In prior art structures one end of the bimetal helix is affixed to the housing, while its other, free terminus conventionally constitutes the portion (tripping portion) which executes the tripping motion.

In tripping devices of the above-outlined type the current terminal connected with the free end of the bimetal helix is constituted by a flexible (braided) wire to ensure that it does not obstruct the free mobility of the bimetal helix. A disadvantage of known helically bent bimetal strips resides in the fact that the tripping motion of the free helix end is, because of the instability of the bimetal helix, particularly in the zone of its free end, can be controlled (guided) in a localized manner only with difficulty along a predetermined path of motion. These difficulties increase as the axial length of the bimetal helix is augmented, that is, as the number of turns of the helix increases. When an overload circuit breaker is used in relatively low-current intensity circuits, the heat generated by the excess current as it passes through a planar bimetal strip may not be sufficient for tripping. Thus, for increasing the electrical resistance (and thus the generated heat) of the bimetal strip, for example, its effective length has to be increased within a very limited space. In such instances helically wound bimetal strips find advantageous application. An appreciable extension of the effective length of the bimetal strip in a narrow space, that is, in case of a small helix diameter, however, requires a certain minimum number of turns and thus the instability of the bimetal strip (which is a direct function of the number of turns) increases precisely at the tripping terminus of the helix.

SUMMARY OF THE INVENTION

It is an object of the invention to provide an improved tripping device of the above-outlined type which has a bimetal strip of greater stability in the zone of its tripping portion.

This object and others to become apparent as the specification progresses, are accomplished by the invention, according to which; briefly stated, the bimetal strip is formed of two electrically serially connected, oppositely wound bimetal helices and further, the bimetal strip is secured to the housing at both ends, while the tripping portion is constituted by the coupling part connecting the two bimetal helices to one another.

By virtue of the structure according to the invention as defined above, the two bimetal helices are arranged parallel to one another as concerns the mechanical forces but they are connected in series with regard to their electric resistance. The effective length of the bimetal strip determined by the required heat output which, in turn, is determined by the electric resistance of the bimetal strip, is distributed along a relatively large number of turns at a relatively small helix diameter, since the bimetal strip is firmly clamped at both ends. As a result, a particularly space-saving tripping device is obtained which has a particularly small dimension in a direction perpendicular to the axis of the helix. Such a structure of narrow construction is of particular significance if one considers that the individual components of the tripping mechanism of an overload circuit breaker are, as a rule, positioned side-by-side in one plane to ensure that if a plurality of overload circuit breakers are connected to one another in juxtapositioned planes, the individual components take up as little space as possible in the direction of the adjacent circuit breakers.

Accoding to a further feature of the invention, both clamped ends of the bimetal strip constitute current terminals. This feature makes it possible to entirely dispense with the braided flexible wire terminals which have been used heretofore to ensure the free mobility of the bimetal strip but which, at the same time have themselves constituted very instable components.

The two bimetal helices may be manufactured separately and can be connected to one another, for example, by welding. According to a further feature of the invention, however, the bimetal strip is a one-piece component. This ensures a particularly advantageous and simple structure of the bimetal strip, since the tripping portion of the bimetal strip constituted by the coupling part between the two bimetal helices is the bimetal strip itself.

In accordance with a further feature of the invention, the two bimetal helices have the same cross section and the same number of turns. This feature results in a symmetrical motion of the two bimetal helices, particularly if, according to further features of the invention, the two bimetal helices are mirror images of one another with respect to a plane of symmetry which extends perpendicularly to the helix axis and medially intersects the tripping portion. The path of motion of the tripping portion and its orientation are, in this manner, precisely localized as if a tripping end of a bimetal helix were positively guided.

In accordance with a further feature of the invention, both inner ends of the bimetal helices are inwardly bent in the direction of the helix axis and project beyond the longitudinal helix axis together with the coupling part constituting the tripping portion. The surface of the tripping portion is oriented approximately radially to the helix axis. In this arrangement, when the bimetal strip is heated, the tripping portion executes a swinging motion about the longitudinal helix axis.

According to still another feature of the invention, both bimetal helices can be adjusted from the outside by means of an adjusting device radially to the helix axis in the direction of the tripping motion of the tripping portion. With the aid of this arrangement an adjustment of the bimetal strip, that is, a setting of the tripping portion into a desired initial position can be effected in a particularly simple manner. By virtue of the attachment of the bimetal strip at both ends, the adjusting device effects a bending of the longitudinal helix axis in its mid zone between the two clamped ends in the direction of the tripping motion of the tripping portion.

According to a further feature of the invention, the adjusting device comprises a set screw, whose longitudinal axis extends perpendicularly to the helix axis and which engages an insulating member which, in turn, acts upon the bimetal helices. Further, the insulating member has, between its two ends of engagement, a lug which projects into the intermediate space between the bimetal helices. The side portions of the lug are only at a very small distance adjacent respective terminal edges of the two bimetal helices. This arrangement ensures a certain additional guidance particularly of the tripping portion during tripping motion without, at the same time, obstructing the bimetal strip in its free mobility necessary for executing the tripping motion.

DESCRIPTION OF THE PREFERRED EMBODIMENT

Figure 1:
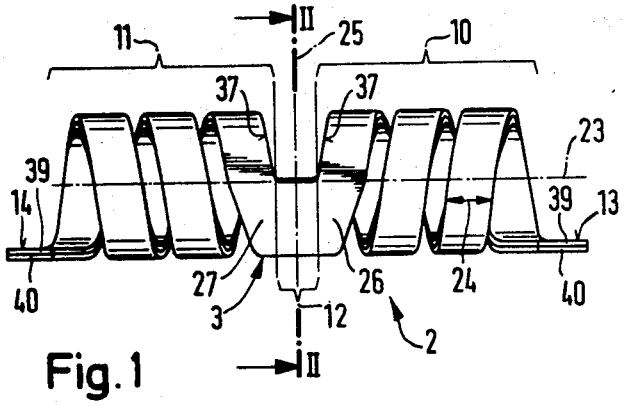
FIG. 1 is a lateral view of the bimetal strip according to the invention.
Figure 2:
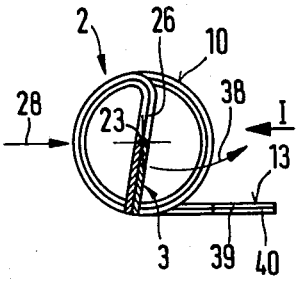
FIG. 2 is a sectional view taken along line II—II of FIG. 1.

Turning now to the Figures, the tripping device for a thermal tripping of an overload circuit breaker is accommodated in a housing having two housing halves 1 (only one shown). The parting plane between the two housing halves coincides with the plane of the drawing FIG. 3. The thermal tripping device comprises a bimetal strip generally located at 2 whose tripping portion 3 is swung outwardly in the direction of the arrow 38 when the bimetal strip undergoes deformation due to the heat generated by an excess current. A tripping pin 6 is longitudinally slidably guided between two housing ribs 7 and 8 and engages, at one end, the tripping portion 3 of the bimetal strip 2, and contacts, at the other end, a compensating bimetal bar 9 connected to a tripping lever 4 which, in turn, is swingably supported in the housing by means of a pivot 5. Upon heat-caused displacement of the tripping portion 3 of the bimetal strip 2, the tripping lever 4 is, via force transmission by means of the tripping pin 6 and the compensating bimetal bar 9, swung in a clockwise direction as viewed in FIG. 3. This type of force-transmitting mechanism is disclosed in U.S. Pat. No. 4,024,487.

With particular reference to FIG. 1, the bimetal strip 2 is formed of two oppositely wound bimetal helices 10 and 11 which, with regard to their electric resistances, are serially connected to one another. The coupling part 12 between the bimetal helices 10 and 11 constitutes the tripping portion 3 of the bimetal strip 2. In the direction of the tripping portion 3, the bimetal helix 10 has a left-hand course, whereas the bimetal helix 11 has a right-hand course. The bimetal strip 2 is clamped into the housing half 1 at its two outer ends 13 and 14 which, respectively, are the outer ends of the helices 10 and 11. The end 14 is welded to a post 15 of a conductor rail 16. The latter is, in turn, fixedly attached to the housing, more precisely to the housing half 1. A terminal clip 17 is welded to the lower end of the conductor rail 16. The terminal clip 17 has a terminal arm which extends through an opening 18 of the housing half 1 and is, at its free end 19, connectable to an external current conductor (not shown).

The outer end 13 of the bimetal strip 2 is affixed to a post 20 of a contact carrier 21 of a stationary contact 22. Thus, the bimetal strip 2 is, with its outer ends 13, 14 fixedly clamped in the housing half 1 while, at the same time, these clamped strip ends serve as current terminals. In the embodiment illustrated, the bimetal strip 2 is a one piece component between its outer ends 13, 14. It has a rectangular cross section and has an outer side 24 oriented parallel to the helix axis 23 which is common to both bimetal helices 10 and 11. The latter have an identical number of turns, such as three, as shown. The bimetal helices 10, 11 are arranged as mirror images of one another with respect to a plane of symmetry 25 which constitutes the sectional plane II—II in FIG. 1 and which extends perpendicularly to the helix axis 23 and intersects the tripping portion 3 in its middle.

Each bimetal helix 10, 11 is formed of two face-to-face arranged bimetal components 39 and 40. The bimetal component 39 which has the property of the greater expansion is arranged at the inside of each helix, whereas the bimetal component 40 which has the property of smaller expansion is at the outside of the helices.

Figure 3:
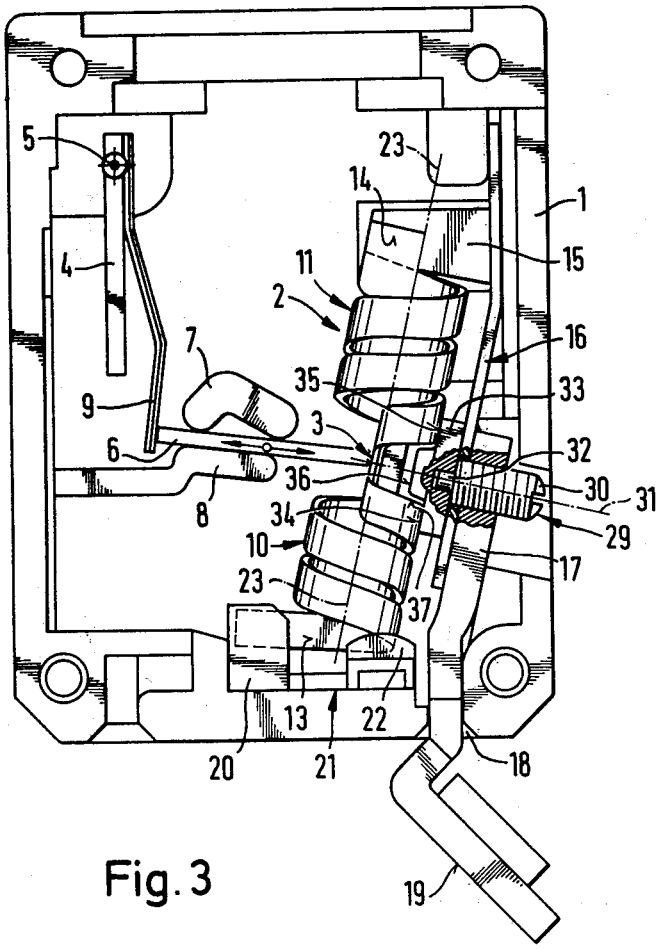
FIG. 3 is a view of an overload circuit breaker incorporating the bimetal strip according to the invention.

The two adjacent ends 26, 27 of the respective bimetal helices 10 and 11 which are oriented towards the helix connection 12 are bent radially inwardly in the direction of the helix axis 23, as best seen in FIG. 3. The ends 26, 27 intersect the helix axis 23 and, together with their coupling part 12 constituting the tripping component 3, project radially outwardly from the helix axis 23. The tripping portion 3, however, is situated still inside an imaginary envelope (such as a cylinder) circumscribable about the bimetal helices 10, 11 for the purpose of saving as much space as possible.

On the terminal clip 17 there is mounted an adjusting device generally indicated at 29 which can exert a force radially towards the helix axis 23 on those turns of the bimetal helices 10 and 11 which adjoin the coupling part 12. Thus, by means of the adjusting device 29, from the outside an adjusting force may be transmitted to the bimetal strip 2 in the direction of motion of the tripping portion 3 (in the direction of the arrow 28), by means of which the helix axis 23 of the bimetal strip 2 can be displaced. The adjusting device comprises a set screw 30 which is threadedly engaged in the terminal clip 17, which, in turn, is affixed to the housing half 1. The axis 31 of the set screw 30 is contained in the plane of symmetry 25 of the two helices 10 and 11. The inner terminus of the set screw 30 carries a pin 32 which projects into an insulating member 33. The latter, in turn, engages end portions 34, 35 of the bimetal helices 10 and 11 which are situated adjacent the coupling part 12. The insulating member 33 has a lug 36 which is situated between the two end portions 34, 35 and which projects into the intermediate space between the two bimetal helices 10, 11. The two lateral faces of the lug 36 are located at a very small, slit-like clearance from the respective edge faces 37 of the helices 10, 11.

By turning the set screw 30 inwardly, the bimetal strip 2 is, between the two outer ends 13 and 14, shifted towards the left as viewed in FIG. 3, whereupon, as a result, the tripping portion 3 moves towards the left. By turning the set screw 30 outwardly, the bimetal strip 2 moves, by virtue of the inherent elasticity of the bimetal helices 10, 11, again into its initial position which is determined by a linear orientation of the helix axis 23.

It is to be understood that the above description of the present invention is susceptible to various modifications, changes and adaptations and the same are intended to be comprehended within the meaning and range of equivalents of the appended claims.

What is claimed is:

1. In an overload circuit breaker including a housing, a tripping device supported in the housing and having a helically wound, current-carrying bimetal strip having an axis and composed of two face-to-face arranged metal components situated, respectively, at the inside and at the outside of the bimetal strip; and a tripping portion forming part of the bimetal strip; the tripping portion executing a tripping motion as the bimetal strip undergoes deformation under the effect of heat generated by an excess current flowing through the bimetal strip; the improvement wherein said bimetal strip is formed of two electrically serially connected, oppositely wound bimetal helices each having an outer end constituting the opposite ends of said bimetal strip; securing means for affixing said bimetal strip to said housing at both said opposite ends; the bimetal helices each having an inner end connected to one another by a coupling part constituting said tripping portion of said bimetal strip; and further wherein said inner ends of said bimetal helices are bent radially inwardly towards said axis and said tripping portion projects radially outwardly from said axis and is situated within an envelope circumscribable about said bimetal helices.

2. An overload circuit breaker as defined in claim 1, wherein said bimetal helices forming said bimetal strip are arranged substantially in a mirror image to one another with respect to a plane of symmetry oriented perpendicularly to said axis and passing medially through tripping portion.

3. An overload circuit breaker as defined in claim 1, wherein said inner ends pass through said axis.

4. An overload circuit breaker as defined in claim 1, further comprising an externally accessible adjusting device supported in said housing and operatively connected with said bimetal helices for displacing them radially with respect to said axis parallel to the path of motion of said tripping portion.

5. An overload circuit breaker as defined in claim 4, wherein said adjusting device is operatively connected with said inner ends of said bimetal helices.

6. An overload circuit breaker as defined in claim 4, wherein said adjusting device comprises a set screw having an end face and an axis oriented perpendicularly to the axis of said bimetal strip and an insulating member being in engagement with said end face of said set screw and with said bimetal helices.

7. An overload circuit breaker as defined in claim 6, wherein said insulating member engages face portions of said bimetal helices; each face portion being bounded by an edge portion forming part of the respective bimetal helix; said insulating member having a lug including lateral faces; said lug projecting into a space bounded by said edge portions of the respective bimetal helices; each lateral face of said lug being arranged at a slit-like clearance from the respective said edge portions.

8. An overload circuit breaker as defined in claim 2, further comprising an externally accessible adjusting device supported in said housing and operatively connected with said bimetal helices for displacing them radially with respect to said axis parallel to the path of motion of said tripping portion; said adjusting device comprising a set screw having an end face and an axis lying in said plane of symmetry; said end face of said set screw being operatively connected with said bimetal strip.

9. An overload circuit breaker as defined in claim 8, wherein said adjusting device is operatively connected with said inner ends of said bimetal helices.

10. An overload circuit breaker as defined in claim 8, wherein said adjusting device further comprises an insulating member being in engagement with said end face of said set screw and with said bimetal helices.

11. An overload circuit breaker as defined in claim 10, wherein said insulating member engages face portions of said bimetal helices; each face portion being bounded by an edge portion forming part of the respective bimetal helix; said insulating member having a lug including lateral faces; said lug projecting into a space bounded by said edge portions of the respective bimetal helices; each lateral face of said lug being arranged at a slit-like clearance from the respective said edge portions.

* * * * *